US005349286A

United States Patent [19]

Marshall et al.

[11] Patent Number: 5,349,286

[45] Date of Patent: Sep. 20, 1994

[54] COMPENSATION FOR LOW GAIN BIPOLAR TRANSISTORS IN VOLTAGE AND CURRENT REFERENCE CIRCUITS

[75] Inventors: Andrew Marshall; Thomas A. Schmidt; Ross E. Teggatz, all of Dallas, Tex.

[73] Assignee: Texas Instruments Incorporated, Dallas, Tex.

[21] Appl. No.: 79,665

[22] Filed: Jun. 18, 1993

[51] Int. Cl.[5] ..... G05F 3/16

[52] U.S. Cl. ..... 323/315; 323/313

[58] Field of Search ..... 323/315, 316, 317, 313, 323/314, 312; 307/296.1, 296.6, 296.7, 296.8

[56] References Cited

U.S. PATENT DOCUMENTS

| | | | |
|---|---|---|---|
| 4,362,984 | 12/1982 | Holland | 323/313 |
| 4,771,228 | 9/1988 | Hester et al. | 323/315 |
| 4,866,312 | 9/1989 | Kearney et al. | 307/496 |
| 4,890,052 | 12/1989 | Hellums | 323/315 |
| 4,890,052 | 12/1989 | Hellums | 323/315 |
| 4,906,863 | 3/1990 | Van Tran | 307/296 |
| 4,939,442 | 7/1990 | Carvajal et al. | 323/231 |
| 5,027,054 | 6/1991 | Rusznyak | 323/314 |
| 5,109,187 | 4/1992 | Guliani | 323/313 |
| 5,121,049 | 6/1992 | Bass | 323/313 |
| 5,146,188 | 9/1992 | Suwada et al. | 331/111 |
| 5,168,209 | 12/1992 | Thiel | 323/313 |
| 5,245,273 | 9/1993 | Greaves et al. | 323/313 |
| 5,289,111 | 2/1994 | Tsuji | 323/314 |

OTHER PUBLICATIONS

Widlar, Robert J., New Developments in IC Voltage Regulators, *IEEE Journal of Solid-State Circuits,* vol. sc-6, No. 1, Feb. 1971, pp. 2-7.

*Primary Examiner*—Steven L. Stephan
*Assistant Examiner*—Adolf Berhane
*Attorney, Agent, or Firm*—Thomas G. Eschweiler; James C. Kesterson; Richard L. Donaldson

[57] ABSTRACT

A bandgap reference circuit 30 includes a current generation circuit 32, a voltage generation circuit 34 connected to current generation circuit 32, and a compensation circuit connected to current generation circuit 32 and voltage generation circuit 34. Current generation circuit 32 sources a current to voltage generation circuit 34 which translates the current into a voltage. Compensation circuit 36 monitors current generation circuit 32 and provides a supplemental current to voltage generation circuit 34. Voltage generation circuit 34 receives the supplemental current and translates it into a supplemental voltage. The summation of the voltage produced by the current received by current generation circuit 32 and the supplemental voltage produced by the supplemental current received by compensation circuit 36 produces a stable reference voltage.

13 Claims, 3 Drawing Sheets

COMPENSATION FOR LOW GAIN BIPOLAR TRANSISTORS IN VOLTAGE AND CURRENT REFERENCE CIRCUITS

FIELD OF THE INVENTION

This invention relates to electronic circuits and more particularly relates to voltage and current reference circuits.

BACKGROUND OF THE INVENTION

Voltage and current reference circuits find many applications in electronic circuit applications. The bandgap reference circuit is a common circuit solution for supplying a voltage or current reference. FIG. 1 is a prior art bandgap circuit 10 and operates as described in "New Developments in IC Voltage Regulators", Widlar, Robert J., *IEEE Journal of Solid State Circuits, Vol. sc*-6, No. 1, Feb. 1971. M1 and M2 act as a standard MOS current mirror providing current to Q1 and Q2 which are configured as a bipolar current mirror. Q1 and Q2 are sized differently; therefore, although they conduct the same current, they have different current densities. Therefore, there will be a difference in their $V_{bc}$ voltages and the difference will be reflected in the current through R1. $V_{out}$ is a voltage reference that is a function of the current through R2 and the base-emitter voltage $V_{be}$ of Q3. Since the current through R2 is mirrored from M2 it is seen that the current through M3 is a function of $\Delta V_{be}$ between Q1 and Q2 and R1. Therefore, $V_{out}$ is a function of the $\Delta V_{bc}$ between Q1 and Q2, the ratio in resistor values R1 and R2, and $V_{be}$ of Q3 as seen below:

$$V_{out}=I(M3)*R2+V_{be}(Q3)$$

and, $$I(M3)=I(M2)=I_c(Q2)\approx I_c(Q2)=\Delta V_{be}/R1$$

where $$\Delta V_{be}=V_{be}(Q2)-V_{be}(Q1).$$

Substituting $\Delta V_{be}/R1$ for I(M3) you get $$V_{out}=(R2R1)*\Delta V_{be}+V_{be}(Q3).$$

If the ratios of R1 and R2 are set appropriately $V_{out}$ will have zero temperature coefficient. This ratio is determined by taking the equation for $V_{out}$ that incorporates all temperature dependencies, differentiating with respect to temperature, and setting the equation equal to zero. This is well known by those skilled in the art of bandgap reference circuits. The above explanation of prior art circuit 10 assumes that the gain (or $h_{FE}$) of Q1 and Q2 are sufficiently high such that $I_c(Q2)$ is approximately $I_c(Q2)$. However, in many cases, this is not a valid assumption. In integrated circuits, $h_{FE}$ mary vary by an order of magnitude for a given process. Additionally, $h_{FE}$ is a strong function of temperature and may increase by 4×from −55° C. to 125° C. Taking into account low $h_{FE}$, the following equations represent circuit 10:

$$V_{out}=I(M3)*R2+V_{be}(Q3)$$

and, $$I(M3)=I(M2)=I_c(Q2)$$

and, $$I_c(Q2)=I_c(Q2)-I_b(Q2)$$

therefore, $$I_c(Q2)=\Delta V_{be}/R1-I_b(Q2)$$

and, $$V_{out}=(R2/R1)*\Delta V_{be}+V_{be}(Q3)-R2*I_b(Q2).$$

Therefore, it can be seen that an error term exists and further, this error term is a function of temperature since $I_b(Q2)$ will vary as $h_{FE}$ varies over temperature. This error term deteriorates the performance of circuit 10 as a voltage reference.

FIG. 2 is a prior art bandgap circuit 20 that incorporates an NMOS transistor M4 as a "beta-helper" and is well known by those skilled in the art. M4 decreases the dependance upon beta ($h_{FE}$) to achieve accurate "mirroring" of current between Q1 and Q2 by minimizing the current needed from the collector terminal of Q1 to supply base drive to Q1 and Q2. Although M4 is effective in that regard it does not eliminate the error term in $V_{out}$ associated with a low $h_{Fe}$ in Q2.

The same error phenomena is also present in bandgap current reference circuits. That is, when bipolar transistors exhibit low gain there is a significant current difference between their collector current and their emitter current. Since the emitter current is what is used to establish the current reference stabilization, a difference between the collector current and emitter current due to low gain causes significant error in establishing a stable current reference.

It is an object of this invention to provide a compensation method and circuit that reduces the negative effect of low gain bipolar transistors in bandgap voltage and current reference circuits. Other objects and advantages of the invention will become apparent to those of ordinary skill in the art having reference to the following specification together with the drawings herein.

SUMMARY OF THE INVENTION

A bandgap reference circuit 30 includes a current generation circuit 32, a voltage generation circuit 34 connected to current generation circuit 32, and a compensation circuit connected to current generation circuit 32 and voltage generation circuit 34. Current generation circuit 32 sources a current to voltage generation circuit 34 which translates the current into a voltage. Compensation circuit 36 monitors current generation circuit 32 and provides a supplemental current to voltage generation circuit 34. Voltage generation circuit 34 receives ! the supplemental current and translates it into a supplemental voltage. The summation of the voltage produced by the current received by current generation circuit 32 and the supplemental voltage produced by the supplemental current received by compensation circuit 36 produces a stable reference voltage.

DESCRIPTION OF THE PREFERRED EMBODIMENT

Figure 2:
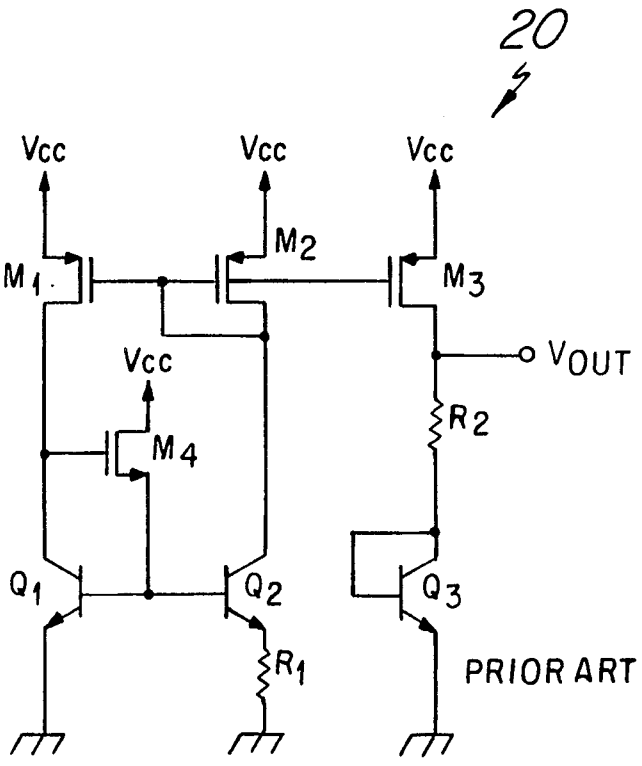
FIG. 2 is schematic diagram illustrating another prior art bandgap circuit 20.
Figure 1:
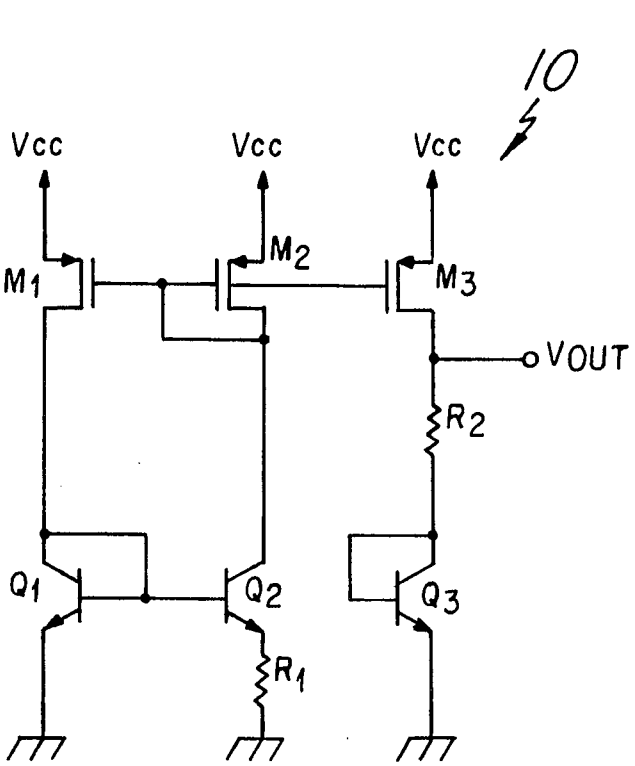
FIG. 1 is a schematic diagram illustrating a prior art bandgap circuit 10.
Figure 3:
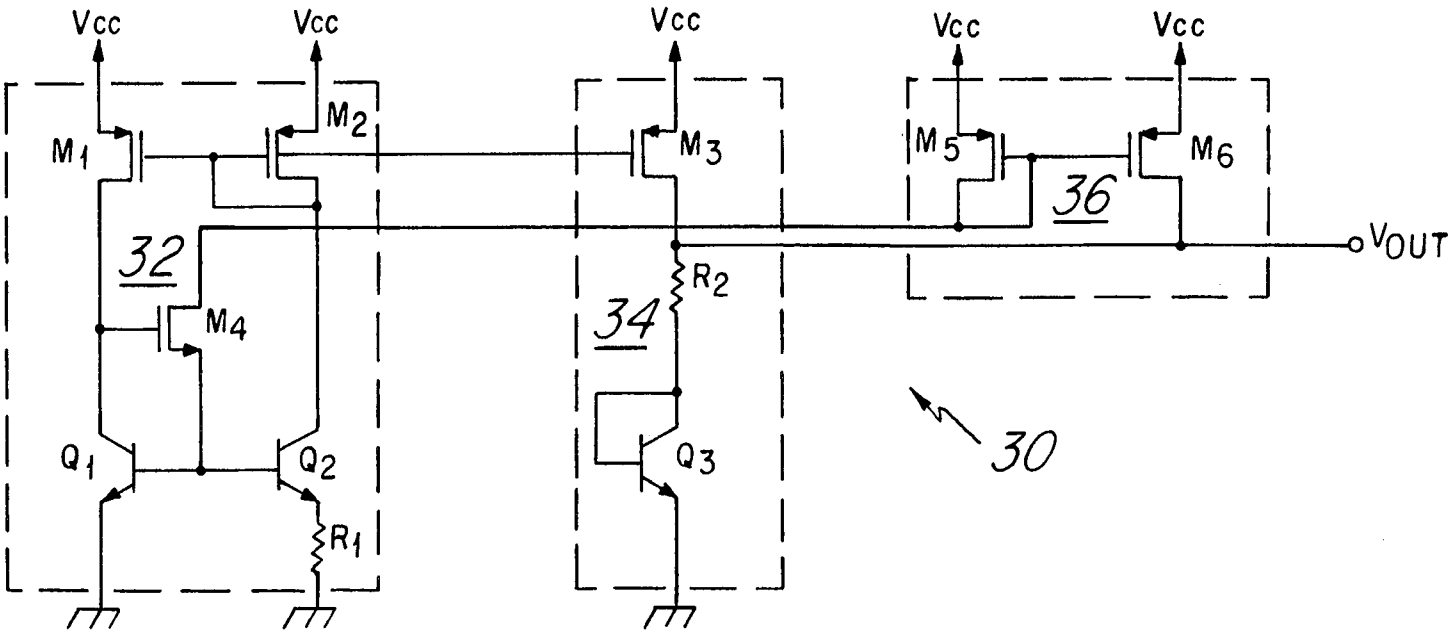
FIG. 3 is a schematic diagram illustrating the preferred embodiment of the invention, a compensated bandgap voltage reference circuit 30.

FIG. 3 is a schematic diagram illustrating the preferred embodiment of the invention, a low gain compensated bandgap voltage reference circuit 30. Circuit 30 has a PMOS transistor M1 having a source connected to Vcc and a gate connected to a gate of a PMOS transistor M2. M1 has a drain connected to a collector of a bipolar transistor Q1 and to a gate of an NMOS transistor M4. M4 has a source connected to a base of Q1 and to a base of a bipolar transistor Q2. Q 1 has an emitter connected to circuit ground and Q2 has an emitter connected to a resistor R1 which in turn is also connected to circuit ground. Q2 has a collector connected to a drain of M2. The gate of M2 is connected to its drain and is also connected to a gate of a PMOS transistor M3. M3 has a source connected to Vcc and a drain connected to a first terminal of a resistor R2. A second terminal of R2 is connected to a collector of a bipolar transistor Q3. The collector of Q3 is connected to its gate and an emitter of Q3 is connected to circuit ground. A drain of M4 is connected to a drain of a PMOS transistor M5. M5 has its drain connected to its gate and to a gate of a PMOS transistor M6. M5 has a source connected to Vcc and M6 has a source connected to Vcc. M6 has a drain connected to the first terminal of R2 and forms the output terminal $V_{out}$ of circuit 30.

Figure 4:
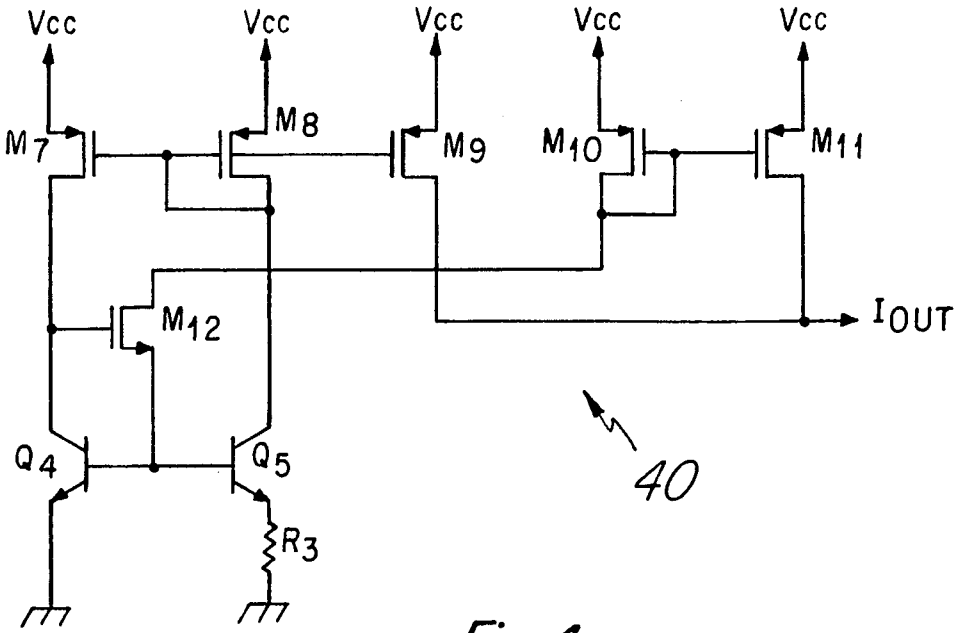
FIG. 4 is a schematic diagram illustrating an alternative embodiment of the invention, a compensated bandgap current reference circuit 40.

FIG. 4 is a schematic diagram illustrating an alternative embodiment of the invention, a low gain compensated bandgap current reference circuit 40. Circuit 40 has a PMOS transistor M7 having a source connected to Vcc and a gate connected to a gate of a PMOS transistor M8. M7 has a drain connected to a collector of a bipolar transistor Q4 and to a gate of an NMOS transistor M12. M12 has a source connected to a base of Q4 and to a base of a bipolar transistor Q5. Q4 has an emitter connected to circuit ground and Q5 has an emitter connected to a resistor R3 which in turn is also connected to circuit ground. Q5 has a collector connected to a drain of M8. The drain of M8 is also connected to its gate. The gate of M8 is also connected to a gate of a PMOS transistor M9. M9 has a source connected to Vcc. A drain of M12 is connected to a drain of a PMOS transistor M10. M 10 has its drain connected to its gate and to a gate of a PMOS transistor M11. M10 has a source connected to Vcc and M11 has a source connected to Vcc. M11 has a drain connected to the drain of M9 and forms the output terminal of circuit 40.

The functionality of circuit 30 of FIG. 3 is now described. M1 and M2 form a current mirror. Since they have the same W/L transistor size ratios they source the same amount of current. Q1 and Q2 also form a current mirror. However, Q1 and Q2 are sized differently (Q1, in this embodiment, is four times larger than Q2) to provide different current densities. Thus the current density J2 of Q2 is four times larger than the current density J 1 in Q1. The difference in current density provides a difference in the base-emitter voltage ($V_{bc}$) of Q1 and Q2. Since $$V_b(Q1)=V_b(Q2),$$

then $$V_{be}(Q1)=V_{be}(Q2)+I_c(Q2)*R1$$

or, $$\Delta V_{be}=V_{be}(Q1)-V_{be}(Q2)=I_c(Q2)*R1.$$

Therefore, the difference in base-emitter voltages of Q1 and Q2 ($V_{be}(Q1)-V_{be}(Q2)$) is shown by the voltage existing across R1.

The current supplied by M2 to Q2 is mirrored to M3. Since, in this particular embodiment, M3 and M2 have the same W/L size ratios, they conduct the same amount of current. M3 feeds R2 and Q3 which provide a voltage drop across R2 and a $V_{bc}(Q3)$ voltage drop across Q3 because Q3 is biased as a diode.

M4 is a "beta-helper" that provides base drive for Q1 and Q2 without substantially affecting the collector current magnitude of Q1. M4, however, is not connected to Vcc as in prior art beta-helper configurations, but rather is connected to M5. M5 and M6 act as a current mirror and play a crucial role in low gain compensation. Since M5 supplies the current to M4 for the base drive it indirectly senses the beta ($h_{FE}$) or gain of Q1 and Q2 at any one time because $$I(M4)=I_b(Q1)+I_b(Q2).$$

If $I_b(Q1)$ and $I_b(Q2)$ are large currents then it can be concluded that the $h_{FE}$ or gain of Q1 and Q2 are small because $I_b=I_c/h_{FE}$. However, if $I_b(Q1)$ and $I_b(Q2)$ are small currents it can, from the same relation, be concluded that the $h_{FE}$ of Q1 and Q2 is large. In either case it is known that an error term exists that is proportional to $h_{FE}$ and is a strong function of temperature. This error term is approximately:

$$V(error)\approx -I_b(Q2)*R2.$$

Since M4 provides $I_b(Q1)$ and $I_b(Q2)$ and since Q1 and Q2 conduct approximately the same current, $I_b(Q1)=I_b(Q2)$ and the current through M4 can be represented as $2*I_b(Q2)$. M5 is designed to be twice the size of M6 in W/L size ratios, therefore M6 conducts half the current of MS. Since M5 conducts $2*I_b(Q2)$ M6 conducts $I_b(Q2)$. M6 supplies this current to R2, supplementing the current from M3. The current in M6 (of a magnitude $I_b(Q2)$) provides an additional voltage drop across R2 of the following amount:

$$V(supplemental)\approx I_b(Q2)*R2.$$

Note this additional voltage drop cancels the error term ($-I_b(Q2)*R2$) caused by the low $h_{FE}$ of Q2. Further since the $h_{FE}$ of Q2 varies with temperature or with semiconductor processing the base drive needed for Q1 and Q2 also varies. M4 dynamically provides the needed base drive from M5. Since M6 constantly provides a current one-half the magnitude of M5, M6 dynamically adjusts to provide the current needed to cancel the error term. In this manner, circuit 30 is not optimized for one process or a nominal temperature, but rather dynamically adjusts to provide low gain compensation across process and temperature variations.

From the discussion of FIG. 3 it follows that M1, M2, M4, Q1, Q2, and R1 acts as a current generation circuit 32 with the current formed in M2 being the current generated by the current generation circuit. It also follows that M3, R2, and Q3 act as a voltage generation circuit 34 which takes the current from current generation circuit 32 and translates it into a voltage. Further, it follows that M5 and M6 form a compensation circuit 36 that measures the base drive of Q1 and Q2 in current generation circuit 32 and creates a supplemental current that is a ratio of the base currents of Q1 and Q2 and supplies the supplemental current to voltage generation circuit 34 which takes the supplemental current and translates it into a supplemental voltage. The supplemental voltage cancels the error provided by current generation circuit 32 due to low gain bipolar transistors Q1 and Q2. It should be noted that even with high gain bipolar transistors at small errors will exist due to the gain of bipolar transistors being finite. In high performance applications such as voltage regulators this compensation methodology will eliminate the error associated with finite gain bipolar transistors in voltage and current reference circuits.

The functionality of alternative embodiment circuit 40 of FIG. 4 is now described. M7 and M8 form a current mirror. Since they both have the same W/L transistor ratios they conduct the same current. Q4 and Q5 also form a bipolar transistor current mirror. Q4 and Q5, however, are different sizes. Since they both conduct the same current, but are different sizes, they have different current densities. Since Q5, in this embodiment, is four times larger than Q4, the current density J4 in Q4 is four times greater than the current density J5 in QS. This difference in current densities creates a difference in base-emitter voltages. This base-emitter voltage difference is seen as the voltage drop across R3. M9 is connected to M7 and M8 and form a current mirror with them. Since M9 has the same W/L size ratio as M7, M9 conducts the same current. The drain of M9 forms the output of circuit 40 $I_{out}$ and provides a stable reference current.

M12 is a beta-helper device that helps diminish the negative effect of low gain bipolar transistors by significantly decreasing the current taken from the collector of Q4 to provide sufficient base drive for Q4 and Q5. However, M12 does not have its drain connected to Vcc as in prior art configurations, but rather is connected to M10. M10 and M11 form a current mirror with M10 providing the current needed by M12 to supply sufficient base drive to Q4 and Q5. Since Q4 and Q5 are matched and are conducting the same currents, the base current being supplied by M12 is evenly split to Q4 and Q5. Therefore $I_b(Q4)=I_b(Q5)$ and the current through M12 can be represented as:

$$I(M10)\approx I(M12)\approx 2*I_b(Q5)$$

M11 is designed having one-half the W/L size ratio at M10. Therefore, M11 conducts one-half the current of M10. Since, $$I(M10)=2*I_b(Q5)$$

then, $$I(M11)=I_b(Q5)$$

Since M9 mirrors the current in M8 and $I(M8)=I_c(Q5)$ it is evident that for low gain transistors a significant deviation will exist between $I_c(Q5)$ and $I_c(Q5)$ and since $I_c(Q5)$ is the desired current to be reflected as the reference current, $I_b(Q5)$, which reflects the error between $I_c(Q5)$ and $I_c(Q5)$, must be added to the current conducting in M9 to eliminate the error. M11 provides $I_b(Q5)$ to $I_{out}$ and compensates for the error in low gain bipolar transistor Q5. Additionally, since $I_b(Q5)$ is a strong function of temperature it is crucial to have a mechanism that dynamically reacts to the changes and provides appropriate compensation. Since M10 dynamically varies its current to M12 depending on the needed base drive of Q4 and Q5, the current in M11 also varies to provide a dynamic $I_b(Q5)$ such that circuit 40 provides effective compensation over temperature or process variation.

Although the invention has been described with reference to the preferred embodiment herein, this description is not to be construed in a limiting sense. Various modifications of the disclosed embodiment as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A bandgap reference circuit, comprising:

a current generation circuit having a bipolar transistor;

a voltage generation circuit connected to the current generation circuit; and a compensation circuit connected to the current generation circuit and the voltage generation circuit, wherein the compensation circuit monitors a current magnitude of the current generation circuit and provides a supplemental current to the voltage generation circuit in response to the current magnitude of the current generation circuit, the supplemental current creating a supplemental voltage in the voltage generation circuit, the supplemental voltage having a magnitude that cancels an error associated with a finite gain of the bipolar transistor.

2. The circuit of claim 1 wherein the current generation circuit comprises:

a current mirror having a first leg and a second leg;

a first bipolar transistor having a collector terminal connected to the first leg of the current mirror, an emitter terminal connected to circuit ground, and a base terminal;

a second bipolar transistor having a collector terminal connected to the second leg of the current mirror, a base terminal connected to the base terminal of the first bipolar transistor, and an emitter terminal, the second bipolar transistor having a different size than the first bipolar transistor;

a first resistance having a first terminal and a second terminal, the first terminal connected to the emitter terminal of the second bipolar transistor and the second terminal connected to circuit ground;

a beta-helper transistor having a first terminal, a second terminal, and a control terminal, the first terminal connected to the compensation circuit, the second terminal connected to the base terminal of the first bipolar transistor, and the control terminal connected to the collector terminal of the first bipolar transistor, wherein the beta-helper transistor provides base drive to the first and second bipolar transistors without substantially decreasing the current in the first leg of the current mirror; and operable to generate a current in the second leg of the current mirror that is a function of a difference in the base-emitter voltages of the first and second bipolar transistors and the magnitude of the first resistance, the difference in the base-emitter voltages of the first and second bipolar transistor caused by different current densities in the first and second bipolar transistors due to their different sizes.

3. The circuit of claim 2 wherein the current mirror comprises:

a first MOS transistor having a first terminal, a second terminal, and a control terminal, wherein the first terminal is connected to a voltage supply, the second terminal is connected to the collector terminal of the first bipolar transistor and forms the first leg of the current mirror, and a control terminal connected to the second terminal of the first MOS transistor; and a second MOS transistor having a first terminal, a second terminal, and a control terminal, wherein the first terminal is connected to the voltage supply, the second terminal is connected to the collector terminal of the second bipolar transistor and forms the second leg of the current mirror, and a control terminal connected to the control terminal of the first MOS transistor.

4. The circuit of claim 1 wherein the voltage generation circuit comprises:

a third MOS transistor having a first terminal, a second terminal, and a control terminal, wherein the first terminal is connected to a voltage supply, and the control terminal is connected to the current generation circuit;

a second resistance having a first terminal and a second terminal, wherein the first terminal is connected to the second terminal of the third MOS transistor and the second terminal is connected to circuit ground; and operable to mirror current from the current generation circuit using the third MOS transistor as a current mirror and translate the current from the current generation circuit to a voltage by conducting the current through the second resistance, whereby the first terminal of the second resistance forms the output of the bandgap voltage reference circuit.

5. The circuit of claim 4 wherein the second resistance comprises:

a resistor having a first terminal and a second terminal, wherein the first terminal forms the first terminal of the second resistance; and a diode having an anode and a cathode, wherein the anode is connected to the second terminal of the resistor, and the cathode forms the second terminal of the second resistance.

6. The circuit of claim 5 wherein the diode comprises a bipolar transistor having a collector terminal, a base terminal, and an emitter terminal, wherein the collector terminal is connected to the base terminal and forms the anode of the diode and the emitter terminal forms the cathode of the diode.

7. The circuit of claim 1 wherein the compensation circuit comprises:

a second current mirror having a first leg and a second leg, wherein the first leg is connected to the current generation circuit and provides a drive current needed to provide the current of the current generation circuit and the second leg is connected to the voltage generation circuit wherein the second leg of the second current mirror provides the supplemental current which is a ratio of the drive current in the first leg of the second current mirror wherein the supplemental current is fed to the voltage generation circuit which transforms the supplemental current into a supplemental voltage and thereby provides compensation for the finite gain of the bipolar transistor in the current generation circuit.

8. The circuit of claim 7 wherein the second current mirror further comprises:

a fourth MOS transistor having a first terminal, a second terminal, and a control terminal, wherein the first terminal is connected to a voltage supply, the control terminal is connected to the second terminal, and the second terminal is connected to the current generation circuit and forms the first leg of the second current mirror; and a fifth MOS transistor having a first terminal, a second terminal, and a control terminal, wherein the first terminal is connected to the voltage supply, the control terminal is connected to the control terminal of the fourth MOS transistor, and the second terminal is connected to the voltage generation circuit and forms the second leg of the second current mirror.

9. A method of providing a stable reference signal, comprising the steps of:

generating a base-emitter voltage difference between a base-emitter voltage of a first bipolar transistor and a base-emitter voltage of a second bipolar transistor;

translating the difference in base-emitter voltages of the two bipolar transistors into a preliminary reference current, wherein the preliminary reference current is proportional to the difference in base-emitter voltages of the two bipolar transistors;

measuring a summation of a base current of the first bipolar transistor and a base current of the second bipolar transistor;

generating a supplemental current, wherein the supplemental current is a ratio of the base current required by two bipolar transistors; and adding the supplemental current to the preliminary reference current, wherein the sum of the preliminary reference current and the supplemental current form a stable reference current that is independent of variations in the gains of the two bipolar transistors.

10. The method of claim 9 wherein generating a base-emitter voltage difference comprises the steps of:

conducting a first current through the first bipolar transistor, the first bipolar transistor exhibiting a first current density; and conducting a second current through the second bipolar transistor, the second bipolar transistor exhibiting a second current density, wherein the first current is approximately equal in magnitude to the second current and the first current density to larger than the second current density.

11. The method of claim 9 wherein the step of translating the difference between the base-emitter voltages of the first bipolar transistor and the second bipolar transistor into a preliminary reference current comprises the step of placing the difference between the base-emitter voltages of the first bipolar transistor and the second bipolar transistor across a resistance wherein the preliminary reference current is a function of the magnitude of the difference between the base-emitter voltages of the first bipolar transistor and the second bipolar transistor and the magnitude of the resistance.

12. The method of claim 9 wherein measuring a summation of a base current of the first bipolar transistor and a base current of the second bipolar transistor comprises the step of sourcing the summation of the two base currents through a transistor.

13. The method of claim 9 wherein generating a supplemental current comprises the step of mirroring the summation of a base current of the first bipolar transistor and the base current of the second bipolar transistor to a transistor that is sized appropriately to provide the supplemental current, wherein the supplemental current is a ratio of the summation of the base currents of the first and second bipolar transistors.

* * * * *